US006540112B1

(12) United States Patent
Studnik

(10) Patent No.: US 6,540,112 B1
(45) Date of Patent: Apr. 1, 2003

(54) DRINK MIX DISPENSING APPARATUS

(76) Inventor: Neil Studnik, 154 S. Island, Golden Beach, FL (US) 33160

( * ) Notice: Subject to any disclaimer, the term of this patent is extended or adjusted under 35 U.S.C. 154(b) by 147 days.

(21) Appl. No.: 10/033,296

(22) Filed: Dec. 28, 2001

(51) Int. Cl.[7] ..... B67D 5/56
(52) U.S. Cl. ..... 222/132; 222/144.5; 222/48
(58) Field of Search ..... 222/132, 144.5, 222/142.6, 142.2, 142.3, 142.5, 142.9, 545, 129, 48; 215/6

(56) References Cited

U.S. PATENT DOCUMENTS 3,297,209 A * 1/1967 Pungitore ..... 222/132
5,495,962 A * 3/1996 Nomura ..... 222/240
6,302,301 B1 * 10/2001 Vette ..... 220/253

* cited by examiner

*Primary Examiner*—Stephanie Willatt
(74) *Attorney, Agent, or Firm*—Malin, Haley & DiMaggio, P.A.

(57) ABSTRACT

A cap dispenser for use with a liquid-holding container that separately stores concentrated mixes within one or more compartments. The mixes are selectively released within the outflow of the liquid contained by the liquid-holding container. By rotating the head assembly of the dispenser, the user can select which concentrated mix, if any, is to be released. The head assembly also offers a sealed position that seals the liquid within the container and the concentrated mixes within their respective storage compartments. The concentrated mixes are selectively dispensed into the outflow of the liquid from the container when the liquid is being poured out so that a mixed liquid, or flavored or fortified a drink is produced.

22 Claims, 4 Drawing Sheets

DRINK MIX DISPENSING APPARATUS

BACKGROUND OF THE INVENTION

1. Field of the Invention

This invention relates to a cap for a beverage container and more particularly, to a drink mix dispensing apparatus adapted to store and controllably release selected drink mix ingredients from a plurality of compartments in order to combine with the out flow of the beverage as it is poured out.

2. Description of Related Art

Pre-mixed flavored or fortified drink beverages are commonly available and sold in grocery and convenience stores. Drink beverages are composed primarily of water. Beverage container caps are well known to prevent the contents of a beverage container from escaping. In addition to pre-mixed flavored or fortified beverages, concentrated mixes are available for preparing flavored or fortified beverages. These mixes are commonly in the form of powder or concentrated syrup.

To prepare a flavored or fortified beverage from concentrated syrup or powder, a large container such as a pitcher is commonly filled with water and the powder or syrup is mixed with the water in the container. A large container is commonly used to prepare multiple servings of the beverage so that the effort required to prepare the beverage is conserved. The prepared beverage is then poured into a glass or other drinking container and consumed.

To prepare a flavored drink, a flavored liquid syrup or powder must first be mixed with water in a container. The contents of the container are poured out and the flavored drink is consumed. To create a different-flavored drink, the same steps must be repeated with a different-flavored mix. A different flavored drink can be mixed in a separate container or can be mixed in the same container after the previously mixed drink has been consumed. The above method of preparing one flavored beverage after another is time consuming and requires the user to use a container, then re-use the container only after its contents have been emptied.

When a consumer wishes to purchase different flavored drinks, whether it is different flavored sodas, i.e. cherry soda or orange soda, or different flavored non-carbonated drinks, he or she must purchase each desired flavor. This proves to be quite costly. In families where there is a diversity of drink favorites, it becomes extremely costly to purchase drinks or sodas to please every family member.

In today's health conscious world, herbal and vitamin supplements are in vogue. Many of these supplements are water-soluble and dissolve easily in water, juice or tea. However, it would be cumbersome to add a supplement to a container of water, juice or tea, empty the bottle of its contents, consume the mixture and then re-fill the container again with water, juice or tea so a different supplement can be added.

What is needed is a drink mix bottle cap dispenser that can be easily attached to a liquid-holding container, and which contains compartments, each housing a different flavored syrup, liquid and/or powder, or a different vitamin and/or herbal supplement, where the user can simply select a flavor or supplement and tip the bottle over so the flavored mix or supplement from the selected container mixes with the liquid to instantly form a flavored drink or soda, or a vitamin-fortified drink. If any contents are remaining in the container, the process can be repeated for a different selection, or the cap can be easily and quickly removed, the beverage replenished, the compartments refilled with drink mixes, or a new cap reattached and the process repeated. A virtually unlimited number of flavored drinks or herbal-fortified beverages can be produced thereby eliminating the need to purchase different flavored beverages.

BRIEF SUMMARY OF THE INVENTION

The present invention provides a beverage cap adapted to be removeably secured to the open end of a liquid-holding container that stores a plurality of concentrated mixes in separate compartments within the cap, which are selectively dispensed and combined with the outflow of the liquid stored in the container thereby producing a variety of liquid-concentrated mix combinations.

In the preferred embodiment, the liquid within the container is a drinkable beverage, such as water or carbonated water, and the concentrated mixes are different flavored liquid or powdered mixes, or different herbal or vitamin supplements. In an alternate embodiment, the mixes could each be a different type of oil.

A cap dispenser for use with a beverage container, which separately stores concentrated beverage mixes that are selectively released and combined with the outflow of the drinkable liquid contained in the beverage container. The resealable cap stores concentrated beverage mixes which are selectively dispensed within the outflow of the beverage container when the liquid is being poured out so that different flavored or vitamin fortified drinks are produced. The resealable cap includes a base, a selector disc and a head assembly.

The base is substantially cylindrical in shape with a top end, a bottom end, an inside surface and an outside surface. The bottom end is open and the inside surface is tapered in diameter from the bottom end to the top end so that at the bottom end the inside surface is substantially the diameter of the base and towards the top end the diameter is reduced so that a bottle aperture is formed. The inside surface of the bottle aperture is sized to accommodate the mouth of a conventional beverage container and is adapted with bottle threads to engage the mouth of a conventional beverage container. The threaded mouth of a conventional bottle is inserted into the bottom end of the base and is rotated upon engaging the bottle threads of the flow aperture until fully engaged and sealed.

Within the base are a plurality separate compartments which hold concentrated mixes. Each compartment is tapered in shape to conform to the tapered shape of the inside surface of the base.

A circular selector platform is disposed upon the base. The selector platform is adapted with six pairs of radially disposed alignment dimples and inner and outer circular ring channels. The inner circular ring channel surrounds the bottle aperture. The outer ring channel is positioned so that it separates pairs of alignment dimples. Compartment apertures are positioned within three pairs of alignment dimples so that compartment apertures alternate in occurrence within alignment dimple pairs. Each pair of compartment apertures open into a corresponding compartment.

A selector disk rotatably engages the selector platform. The selector disk is adapted with six pairs of radially disposed raised alignment flanges which are equally spaced apart along the bottom surface of the disk so that they may properly engage corresponding dimples located on the selector platform. Each pair of alignment flanges corresponds with a pair of alignment dimples so that when the selector disk engages the selector platform the corresponding alignment flanges engage the corresponding alignment dimples. The bottom surface of the selector disk is also adapted with a pair of raised circular ring tracks. The ring tracks are positioned so that when the selector disk engages the selector platform the corresponding tracks of the selector disk engage the corresponding channels of the selector platform.

The selector disc includes apertures, which allow access to the drink fluid of the attached bottle and the concentrated drink mixes contained within the compartments. A hollow flow spout extends from the top of the selector disc towards the outside perimeter of the selector disc. A mix spout extends from the top of the selector disc and is connected to the lower portion of the flow spout thereby allowing the selected drink mix to combine with the drink beverage. A vacuum spout extends from the top of the selector disc in the opposite direction of the flow spout to allow for unimpeded flow of the combined liquid and concentrated mix.

A head assembly holds the selector disk in engagement with the selector platform of the base. The head assembly is formed by a substantially cylindrical body and a top. The top of the head assembly is adapted in shape to receive the selector disc so that the flow spout is exposed through a pour aperture. When the head assembly fully engages the base, the raised ring tracks of the selector disc engage the cooperating ring channels of the selector platform and corresponding alignment flanges engage of the selector disc engage alignment dimples of the selector platform.

In use, the head assembly and selector disc enclosed therein are rotated in relation to the base. While rotating, the head assembly snaps into six unique positions that are created when the alignment dimples of the selector platform and the raised flanges of the selector disc engage. Each position is unique and is identified by indicator markings on the outside of the base and which are revealed through one or more windows in the head assembly as the head assembly is rotated into different positions.

Each position causes the alignment of apertures within the selector disc with respect to the selector platform to change. A closed position causes all apertures to be closed and sealed so that neither the bottle's liquid contents or the concentrated mixes can escape.

To pour out the contents of the attached container, the head assembly is rotated to one of the five positions that do not completely seal the container. The container is then simply tipped over so that gravity causes the bottle contents to flow out through the bottle aperture of the base through the flow spout. When a drink blended with a concentrated mix is desired the head assembly is rotated so that the aperture within the selector disc opens into the compartment containing the desired drink mix and as the container is tipped over the desired drink mix contained in the corresponding compartment are allowed to combine with and flow out along with the bottle contents. The concentrated mix is blended with the bottle contents within the outflow so that a flavored or fortified drink is formed as the container's contents are being poured out. To prepare a different-flavored drink, the head assembly is simply rotated so that the compartment containing the desired concentrated mix is selected and the contents of the container is blended with the concentrated mix as it is being poured out.

Another position can be selected to release the bottle's liquid contents, i.e. plain water or carbonated water, tea or juice, without releasing any of the drink mixes, thereby releasing only the bottle's contents, i.e. water, tea or juice.

In accordance with these and other objects which will become apparent hereinafter, the instant invention will now be described with particular reference to the accompanying drawings.

DETAILED DESCRIPTION OF THE INVENTION

Figure 1:
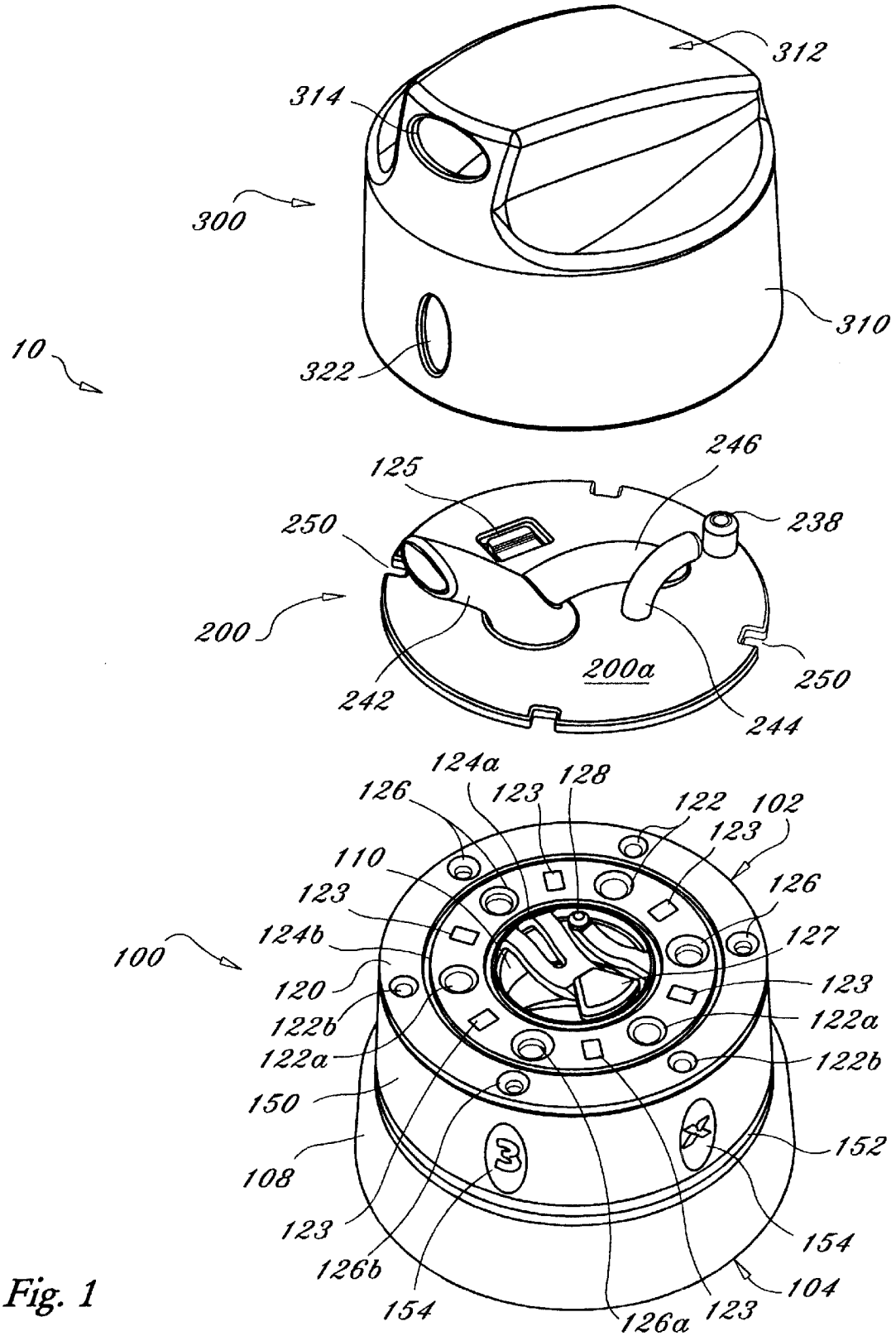
FIG. 1 is a top exploded perspective view of the drink mix dispensing apparatus of the present invention.
Figure 3:
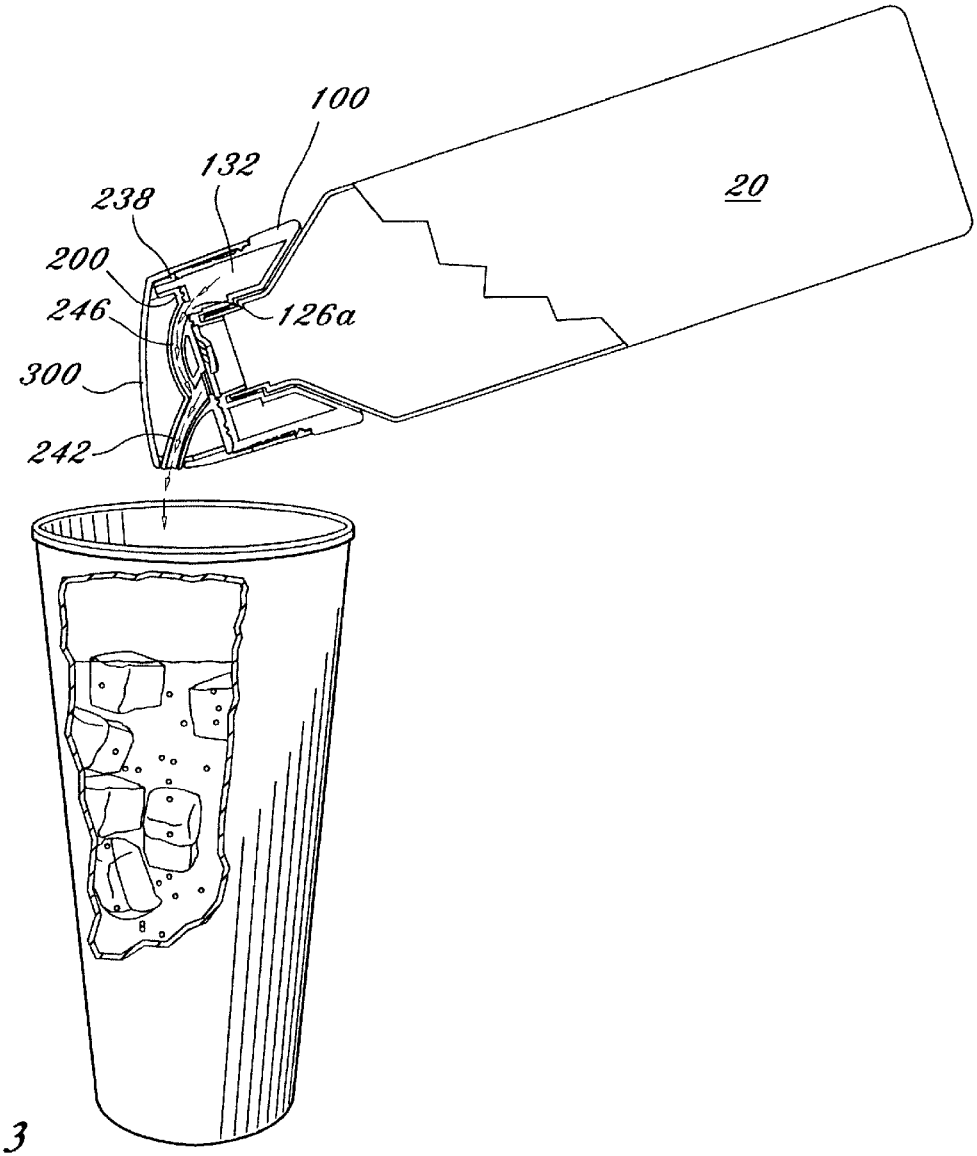
FIG. 3 is a side view showing the drink mix dispensing apparatus in use.
Figure 4:
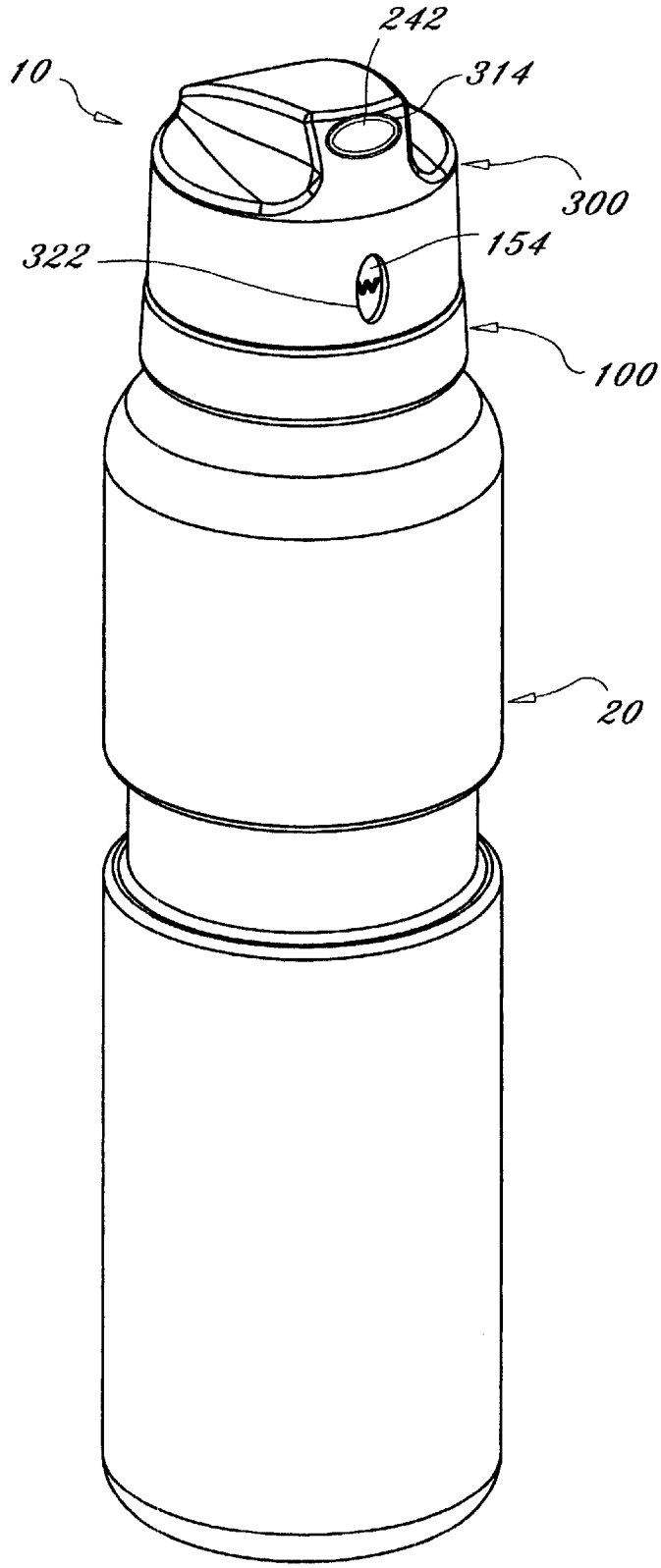
FIG. 4 is a front view showing the drink mix dispensing apparatus of the present invention affixed to a conventional beverage container.

Referring now to FIG. 1, an exploded view of the drink mix dispensing apparatus of the present invention is illustrated. The invention includes a base assembly 100, a selector disc 200 and a head assembly 300 which together form a dispensing cap 10 used to seal a conventional beverage container 20 which contains a liquid drink as seen in FIGS. 3 and 4. Container 20 can be off-the-shelf two-liter bottles, 500 ml bottles and other bottles or cans offered for sale containing soda, juice, water, carbonated water and other beverages. In the preferred embodiment, container 20 is a conventional water or soda bottle with a threaded spout.

Figure 2:
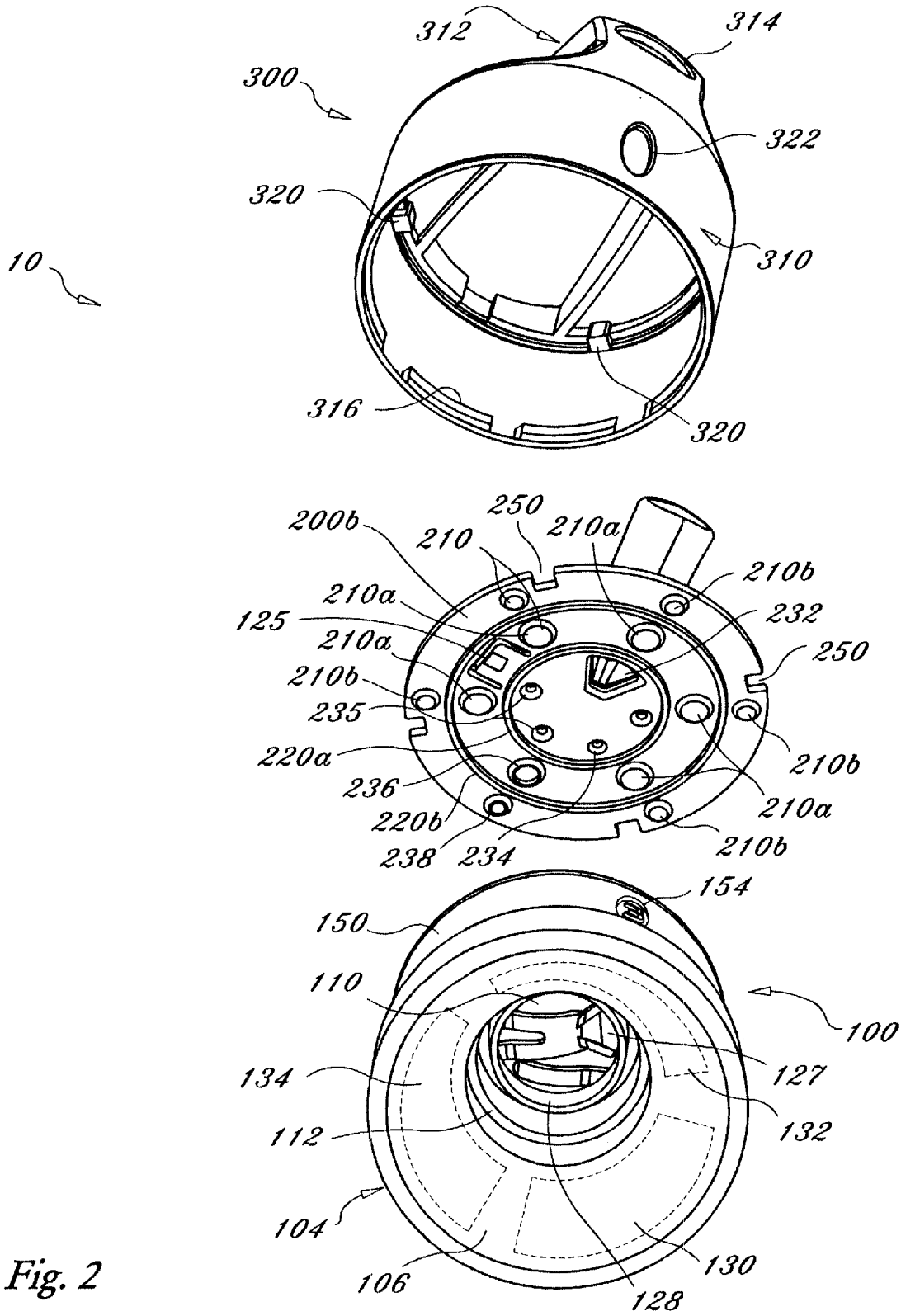
FIG. 2 is a bottom exploded perspective view of the drink mix dispensing apparatus of the present invention.

Base 100 is substantially cylindrical in shape with a closed top end 102, an open bottom end 104, a tapered inside surface 106 and an outside surface 108 as shown in FIGS. 1 and 2. Bottom end 104 is open and inside surface 106 is tapered in diameter from bottom end 104 to top end 102 so that at bottom end 104, inside surface 106 is substantially the diameter of base 100 and towards top end 102 the diameter of inside surface 106 is reduced so that a bottle receiving aperture 110 is formed. Bottle receiving aperture 110 is sized to accommodate the mouth of a conventional beverage container 20. Inside surface 106 is adapted in size to accommodate the top portion of container 20. Inside surface 106 at bottle aperture 110 includes bottle threads 112 to engage corresponding threads on the mouth of conventional beverage container 20.

In use, the threaded mouth of container 20 is inserted into bottom end 104 of base 100 and is rotated upon bottle threads 112 until fully engaged and sealed within bottle aperture 110 as seen in FIGS. 3 and 4. Top end 102 is substantially flat forming a circular selector platform 120.

In FIG. 2, embedded within base 100 are three compartments 130, 132 and 134, which hold concentrated mixes (preferably liquid). Each compartment 130, 132 and 134 is tapered in shape to conform to the tapered shape of inside surface 106.

In the preferred embodiment, three mix-holding compartments 130, 132 and 134, each containing a different flavored liquid drink mix or a different vitamin or herbal supplement, are embedded within base 100. The concentrated drink mix combines with a liquid flowing out of the container to form a mixed liquid, preferably a drinkable mixed beverage. It is, however, within the scope of the invention to include either a greater or a fewer number of compartments, and for each compartment to house powdered or granular drink mixes, herbal or vitamin supplements, or various types of oils, each of which, when dispensed, combines with the liquid contents of the container as it exits the container.

Circular selector platform 120 is disposed upon and is an integral part of base 100. In the preferred embodiment, platform 120 is adapted with three pairs of spaced apart radially disposed alignment dimples 122. Each pair of alignment dimples is comprised of a mix dimple 122*a* and a vacuum dimple 122*b*. Each mix dimple 122*a* is positioned radially around bottle aperture 110 creating an interior circle. Each vacuum dimple 122*b* is positioned adjacent and just outside a corresponding mix dimple 122*a*. Each vacuum dimple 122*b* is positioned radially along an outer circle, said outer circle encircling the inner circle formed by mix dimples 122*a*. Both inner circle of mix dimples 122*a* and the concentric outer circle of vacuum dimples 122*b*, encircle bottle aperture 110.

Circular selector platform 120 is also adapted with inner and outer circular ring channels 124*a* and 124*b*. Inner ring channel 124*a* surrounds bottle aperture 110. Outer ring channel 124*b* is positioned so that it separates each mix dimple 122*a* from its corresponding vacuum dimple 122*b*.

Along with the alignment dimples 122, and also disposed on the upper face of base 100, are three pairs of compartment apertures 126. Each pair of compartment apertures 126 is comprised of a mix compartment aperture 126*a* and a vacuum compartment aperture 126*b*. Compartment apertures 126 alternate in occurrence within pairs of alignment dimples 122. Each pair of compartment apertures 126 open into a corresponding compartment 130, 132 or 134. Six alignment divots 123 are positioned radially between mix dimples 122*a* and mix compartment apertures 126*a*.

Although both mix compartment apertures and vacuum compartment apertures open into a corresponding compartment, drink mix only flows out of mix compartment aperture, as can be seen more clearly in FIG. 3. Due to gravity, the drink mix contents (indicated by the arrows) flow out of compartment 132 through mix compartment aperture 126*a* as seen in FIG. 3. Vacuum compartment aperture 126*b* allows air to flow freely, facilitating the dispensing and flow of drink mix through mix compartment aperture 126*a* into mix spout 246.

Selector disc 200 is a substantially flat, circular disk having a top surface 200*a* and a bottom surface 200*b*. Selector disc 200 and selector platform 120 are substantially the same diameter. Selector disc 200 rotatably engages selector platform 120. Selector disc 200 is adapted with six pairs of radially disposed circular raised alignment flanges 210 which are equally spaced apart along bottom surface 200*b*. Each pair of raised alignment flanges 210 is comprised of a mix flange 210*a* and a vacuum flange 210*b* which are sized to properly engage mix dimples 122*a* and vacuum dimples 122*b* respectively. Each pair of alignment flanges 210 corresponds with a pair of alignment dimples 122 so that when selector disk 200 engages selector platform 120, corresponding alignment flanges 210 engage corresponding alignment dimples 122.

Additionally, selector disc 200 is adapted with a biased alignment finger 125 which projects from the bottom surface 200*b* of disk 200. Alignment finger 125 engages an alignment divot 123 located on base 100, when corresponding alignment flanges 210 properly engage corresponding alignment dimples 122. Bottom surface 200*b* is adapted with raised inner and outer ring tracks 220*a* and 220*b* which correspond in position with the inner and outer ring channels 124*a* and 124*b* so that when selector disk 200 engages selector platform 120, corresponding inner ring track 220*a* engages inner ring channel 124*a* and corresponding outer ring track 220*b* engages ring channel 124*b* thereby providing an additional sealing mechanism of disc 200 upon base 100.

Selector disc 200 provides apertures which allow access to the drink fluid contained in the attached bottle 20 and the concentrated mixes contained within compartments 130, 132 and 134. Referring to FIG. 2, a mix selector aperture 236 and a vacuum selector aperture 238 are positioned between a pair of alignment flanges 210. One mix selector aperture 236 is positioned between one mix flange 210*a* and one vacuum selector aperture 238 is positioned between a corresponding vacuum flange 210*b*. Mix selector aperture 236 allows the out flow of the selected mix from its compartment via mix spout 246 when a selector aperture 236 is aligned directly over a compartment aperture 126. This is accomplished by simply rotating the head assembly 300, which in turn, rotates disk 200 upon base 100. Vacuum selector aperture 238 allows for the transfer of air and the unimpeded flow of liquid mix through mix spout 246.

A bottle flow aperture 232 is disposed within inner ring track 220*a*. A bottle vacuum aperture 234 is located inside inner ring track 220*a* substantially adjacent to inner ring track 220*a* and substantially opposite bottle flow aperture 232. Three vacuum stopper dimples 235 are disposed inside inner ring track 220*a* so that bottle vacuum aperture 234 and vacuum stopper dimples 235 form a circle around the center of selector disc 200.

A hollow flow spout 242 is disposed upon the top surface 200*a* of selector disc 200 covering bottle flow aperture 232. Flow spout 242 extends from the top of selector disc 200 towards the outer perimeter of selector disc 200 opposite mix and vacuum selector apertures 236 and 238. Mix spout 246 is connected to the top surface 200*a* of selector disc 200 covering mix selector aperture 236. Mix spout 246 is connected at one end to top surface 200*a* of selector disc 200 and at the opposite end to flow spout 242. A vacuum spout 244 is connected to the top 200*a* of selector disc 200 covering bottle vacuum aperture 234 and extends towards the outer perimeter of selector disc 200 in substantially the opposite direction of flow spout 242. Vacuum spout 244 does not reach the outer edge of selector disc 200.

Vacuum spout 244 allows for the flow of liquids through and out of flow spout 242. Vacuum spout 244 is bent towards the back of disk 200 away from and in the opposite direction of flow spout 242 so that when bottle 20 is tipped in pouring position, liquid does not flow inadvertently out of vacuum spout 244 instead of flow spout 242.

A head assembly 300 holds selector disk 200 in engagement with the selector platform portion 120 of base 100. Head assembly 300 is formed by a hollow substantially cylindrical body 310, top end 312 and is open at its opposite end. The interior of head assembly 300 is adapted in shape to receive selector disc 200 so that flow spout 242 extends through a pour aperture 314. The diameter of body 310 is substantially equivalent to the diameter of base 100 at bottom end 104. The upper portion of outside surface 108 of base 100 is reduced in diameter forming collar 150. Body 310 is adapted with periodically occurring raised rotator flanges 316 located along the inside surface of body 310 substantially adjacent to the open end of body 310 as seen in FIG. 2. Alternatively, rotator flanges 316 can be a continuous raised ring along the inner circumference of the open lower end of body 310. The outer circumference of collar 150 is adapted with a rotator channel 152 which is adapted to receive rotator flanges 316. Head assembly 300 engages collar 150 so that body 310 overlaps collar 150 and rotator flanges 316 engage rotator channel 152. The engagement of rotator flanges 316 and rotator channels 152 lock head assembly 300 onto base 100 while allowing it to rotate in either direction in relation to base 100. When head assembly 300 engages base 100, selector disc 200 fully engages selector platform 120 so that inner and outer raised ring tracks 220*a* and 220*b* engage cooperating inner and outer ring channels 124*a* and 125*b*.

Head assembly 300 is rotatable in relation to base 100 so that one of a plurality of positions may be selected. In the preferred embodiment, six selections are available: three drink mix selections; two selections to allow only the contents of the beverage container 20 and not any drink mixes to flow, and one selection to prevent any liquid or drink mix from exiting. Selector disk 200 rotates along with head assembly 300. Selector disk 200 is held in alignment with head assembly 300 by four protrusions 320 which extend from top 312 and are received by grooves 250 in selector disc 200. While rotating, head assembly 300 snaps into six unique positions which are created when alignment dimples 122 engage raised alignment flanges 210 and alignment finger 125 engages alignment divot 123. Each unique position may be identified by indicator markings 154 located along collar 150 which are revealed by an indicator window 322 within body 310 as shown in FIG. 4.

Each discrete position causes mix selector aperture 236 and vacuum selector aperture 238 to be positioned over either a pair of (closed) alignment dimples 122 or (open) compartment apertures 126. Alignment over the dimples 122 causes all apertures to be closed and sealed so that the concentrated mixes cannot escape from the compartments 130, 132, and 134. In one or more of the alignment positions, not only do mix selector aperture 236 and vacuum selector aperture 238 cover closed dimples 122 preventing egress of the drink mix from the compartment, but flow stopper 127 also covers bottle flow aperture 232 thereby preventing liquid from exiting container 20.

Therefore, in the closed position, bottle flow aperture 232 and bottle vacuum aperture 234 are closed by a biased flow stopper 127 and vacuum stopper 128, respectively, which extend from selector platform 120 within bottle aperture 110. In the closed position, compartment apertures 126 are sealed by engagement with alignment flanges 210, which do not contain apertures. In the closed position, mix and vacuum selector apertures 236 and 238 are sealed by engagement with dimples 122, which do not contain apertures. When not in a closed position, vacuum stopper 128 may engage vacuum stopper dimples 235.

To pour out only the contents of the attached bottle, without any drink mixes, head assembly 300 is rotated to one of the positions where bottle flow aperture 232 and vacuum aperture 234 are not blocked by flow stopper 127 and vacuum stopper 128. Bottle 20 is simply tipped over horizontally so that gravity causes the bottle contents to flow out the bottle mouth through bottle aperture 110, bottle flow aperture 232 and out flow spout 242 as seen in FIG. 3. When a drink blended with a drink mix is desired, mix selector aperture 236 and vacuum selector aperture 238 are aligned over one of the three pairs of compartment apertures 126 which open into compartments 130, 132 or 134. As bottle 20 is tipped over, the concentrated drink mix contained in the corresponding compartment 130, 132 or 134 is allowed to flow out into the mix spout 246 and combine with the out-flowing liquid from the bottle in flow spout 242, as seen in FIG. 3. The concentrated mix is blended with the bottle contents within flow spout 242 so that a flavored or fortified drink is produced as the bottle contents are poured out.

Each of the six functional positions including the closed position may be marked so that the desired position is easily located by placing indicator markings 154 along collar 150 which are correspondingly revealed through window 322 as head assembly 300 is rotated so that the function of each position is easily identified. For example, indicator markings 154 could be "1", "2", and "3", each representing a different compartment containing a different drink mix; "w", representing water only (or whatever the liquid is within container 20), without the release of a drink mix; and "x" representing no exit of either the liquid within the container or a drink mix, i.e. a "sealed" selection.

Head assembly 300, selector disc 200 and base 100 may be constructed of any resilient waterproof material such as plastic or resin.

In an alternate embodiment, head assembly 300 and selector disk 200 are one integral component.

The instant invention has been shown and described in what is considered to be the most practical and preferred embodiment. It is recognized, however, that departures may be made therefrom within the scope of the invention and that obvious modifications will occur to persons skilled in the art.

What is claimed is:

1. A liquid mixing and dispensing apparatus comprising:

a liquid container cap attachable to a conventional container containing a liquid, said cap comprising one or more compartments for storing concentrated mixes, said cap including means to selectively allow the liquid of said container and one of said stored mixes within said compartments to combine and flow out of said cap when the container is tipped past a substantially horizontal position.

2. The liquid mixing and dispensing apparatus of claim 1 wherein said cap is comprised of:

a base assembly containing said one or more mix compartments, each said compartment including a compartment aperture;

said means to selectively allow the liquid of said container and one of said stored mixes within said compartments to combine and flow out includes a selector disk assembly having a container flow spout positioned substantially above a container flow aperture and a mix spout positioned substantially above a mix aperture, whereby said mix spout is connected to said container flow spout in order to provide fluid communication between a dispensed mix and said liquid exiting said container, said selector disk assembly rotatable upon said base assembly,; and a head assembly enclosing said selector disk assembly and rotatably disposed upon said base assembly such that upon rotation of said head assembly to a desired location, said mix aperture is aligned with said compartment aperture thereby allowing said mix from said compartment to escape through said compartment aperture and fluidly combine with said liquid from said container in said container flow spout.

3. The liquid mixing and dispensing apparatus of claim 2 wherein said head assembly includes means for snapping into one or more selected functional positions, each said functional position corresponding to release of a selected mix.

4. The liquid mixing and dispensing apparatus of claim 3 wherein each said functional position is indicated by indicia printed on said base assembly and viewable through one or more windows on said head assembly.

5. The liquid mixing and dispensing apparatus of claim 2 wherein said mixes are in powdered form.

6. The liquid mixing and dispensing apparatus of claim 2 wherein said mixes are comprised of herbal supplements.

7. The liquid mixing and dispensing apparatus of claim 2 wherein said mixes are comprised of vitamin supplements.

8. The liquid mixing and dispensing apparatus of claim 2 wherein said mixes are comprised of different flavored liquids.

9. The liquid mixing and dispensing apparatus of claim 2 wherein said mixes are comprised of different oils.

10. The liquid mixing and dispensing apparatus of claim 2 wherein said liquid is comprised of water.

11. The liquid mixing and dispensing apparatus of claim 2 wherein said liquid is comprised of carbonated water.

12. The liquid mixing and dispensing apparatus of claim 2 wherein said s elector disk further comprises a vacuum spout to allow for unimpeded flow of said liquid and said combined one of said mixes through said container flow spout.

13. A liquid mixing and dispensing assembly comprising:

a container containing a liquid; and a dispensing cap attachable to said container, said dispensing cap having on e or more compartments for storing concentrated mixes, said cap including means to selectively allow the liquid of said container and one of said stored mixes within said compartments to combine and flow out of said cap when the container is tipped past a substantially horizontal position.

14. The liquid mixing and dispensing assembly of claim 13 wherein said cap is comprised of:

a base assembly containing said one or more mix compartments, each said compartment including a compartment aperture;

means to selectively allow the liquid of said container and one of said stored mixes within said compartments to combine and flow out includes a selector disk assembly having a container flow spout positioned substantially above a container flow aperture and a mix spout positioned substantially above a mix aperture whereby said mix spout is connected to said container flow spout in order to provide fluid communication between a dispensed mix and said liquid exiting said container, said selector disk assembly rotatable upon said base assembly; and a head assembly enclosing said selector disk assembly and rotatably disposed upon said base assembly such that upon rotation of said head assembly to a desired location, said mix aperture is aligned with said compartment aperture thereby allowing said mix from said compartment to escape through said compartment aperture and fluidly combine with said liquid from said container in said container flow spout.

15. The liquid mixing and dispensing assembly of claim 13 wherein said head assembly includes means for snapping into one or more selected functional positions, each said functional position corresponding to release of a selected mix.

16. The liquid mixing and dispensing assembly of claim 15 wherein said functional positions are indicated by indicia printed on said base assembly and viewable through one or more windows on said head assembly.

17. The liquid mixing and dispensing assembly of claim 13 wherein said mixes are in powdered form.

18. The liquid mixing and dispensing assembly of claim 13 wherein said mixes are comprised of herbal supplements.

19. The liquid mixing and dispensing assembly of claim 13 wherein said mixes are comprised of vitamin supplements.

20. The liquid mixing and dispensing assembly of claim 13 wherein said mixes are comprised of different flavored liquids.

21. A method of dispensing one of a plurality of concentrated mixes separately housed within a dispensing cap, into a flow of liquid, said liquid housed within a beverage container removably affixed to said dispensing cap, said method comprising the steps of:

providing said beverage container containing said liquid; and attaching said dispensing cap to said container, said dispensing cap having one or more compartments for storing said mixes, said dispensing cap including means to selectively allow the liquid of said container and one of said stored mixes within said compartments to combine and flow out of said dispensing cap when the container is tipped past a substantially horizontal position.

22. The method of claim 21 wherein said dispensing cap is comprised of:

a base assembly containing said one or more mix compartments, each said compartment including a compartment aperture;

means to selectively allow the liquid of said container and one of said stored mixes within said compartments to combine and flow out includes a selector disk assembly having a container flow spout positioned substantially above a container flow aperture and a mix spout positioned substantially above a mix aperture whereby said mix spout is connected to said container flow spout in order to provide fluid communication between a dispensed mix and said liquid exiting said container, said selector disk assembly rotatable upon said base assembly; and a head assembly enclosing said selector disk assembly and rotatably disposed upon said base assembly such that upon rotation of said head assembly to a desired location, said mix aperture is aligned with said compartment aperture thereby allowing said mix from said compartment to escape through said compartment aperture and fluidly combine with said liquid from said container in said container flow spout.

* * * * *